US009303464B2

(12) United States Patent
Peters

(10) Patent No.: US 9,303,464 B2
(45) Date of Patent: Apr. 5, 2016

(54) WIRED PIPE COUPLER CONNECTOR

(71) Applicant: Volker Peters, Wienhausen (DE)

(72) Inventor: Volker Peters, Wienhausen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 455 days.

(21) Appl. No.: 13/850,539

(22) Filed: Mar. 26, 2013

(65) Prior Publication Data

US 2014/0290930 A1 Oct. 2, 2014

(51) Int. Cl.
*E21B 17/00* (2006.01)
*E21B 17/02* (2006.01)

(52) U.S. Cl.
CPC ..... *E21B 17/028* (2013.01); *Y10T 29/49002* (2015.01)

(58) Field of Classification Search
CPC ..... E21B 17/003; E21B 17/028
See application file for complete search history.

(56) References Cited

U.S. PATENT DOCUMENTS

| | | | |
|---|---|---|---|
| 6,288,548 | B1 | 9/2001 | Thompson et al. |
| 6,392,317 | B1 | 5/2002 | Hall et al. |
| 6,670,880 | B1 | 12/2003 | Hall et al. |
| 6,836,218 | B2 | 12/2004 | Frey et al. |
| 6,995,684 | B2 | 2/2006 | Clark |
| 7,598,886 | B2 | 10/2009 | Hall et al. |
| 7,692,428 | B2 | 4/2010 | Clark et al. |
| 8,242,928 | B2 | 8/2012 | Prammer |
| 2004/0060708 | A1 | 4/2004 | Clark et al. |
| 2006/0158296 | A1 | 7/2006 | Hall et al. |
| 2010/0175890 | A1 | 7/2010 | Bray et al. |
| 2012/0176138 | A1 | 7/2012 | Prammer |
| 2014/0144614 | A1 * | 5/2014 | Buda et al. ..... 166/65.1 |

OTHER PUBLICATIONS

Shah, V., et al.; "Design Considerations for a New High Data Rate LWD Acoustic Telemetry System"; SPE 88636; Society of Petroleum Engineers, Inc.; p. 1-7; 2004.

Notification of Transmittal of the International Search Report and the Written Opinion of the International Searching Authority, or the Declaration; PCT/US2014/031810; Jul. 11, 2014, 10 pages.

* cited by examiner

*Primary Examiner* — Robert E Fuller
*Assistant Examiner* — Steven MacDonald
(74) *Attorney, Agent, or Firm* — Cantor Colburn LLP

(57) ABSTRACT

A wired pipe coupler includes a coupler carrier having a first side and a second side opposite the first side, first and second metal plates carried by the first side and one or more antennas supported by the second side. The coupler also includes one or more electrical connectors electrically coupling the metal plates to one or more of the one or more antennas, a grounding plate formed of a conductive material and a layer of insulating material disposed between the metal plates and the grounding plate. The first metal plate, the grounding plate and the layer of insulating material form a first capacitor and the second metal plate, the grounding plate and the layer of insulating material form a second capacitor.

20 Claims, 9 Drawing Sheets

WIRED PIPE COUPLER CONNECTOR

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various connecting mechanisms, such as threaded connections.

Various power and/or communication signals may be transmitted through the pipe segments via a "wired pipe" configuration. Such configurations include electrical, optical or other conductors extending along the length of selected pipe segments. The conductors are operably connected between pipe segments by a variety of connecting configurations.

One such connecting configuration includes a threaded male-female configuration often referred to as a pin-box connection. The pin-box connection includes a male member, i.e., a "pin end" that includes an exterior threaded portion, and a female member, i.e., a "box end," that includes an interior threaded portion and is configured to receive the pin in a threaded connection.

Some wired pipe configurations include a coupler mounted on/in the pin as well as in the box end. The coupler transmits power, data or both to an adjacent coupler. The coupler in the pin end is typically connected via a transmission line such as a coaxial cable to a coupler in the box end.

BRIEF DESCRIPTION

Disclosed herein is a wired pipe coupler that includes a coupler carrier having a first side and a second side opposite the first side, first and second metal plates carried by the first side and one or more antennas supported by the second side. The coupler also includes one or more electrical connectors electrically coupling the metal plates to one or more of the one or more antennas, a a grounding plate formed of a conductive material and a layer of insulating material disposed between the metal plates and the grounding plate. The first metal plate, the grounding plate and the layer of insulating material form a first capacitor and the second metal plate, the grounding plate and the layer of insulating material form a second capacitor.

Also disclosed is method of forming a wired pipe coupler. The method includes: providing a coupler carrier having a first side and a second side opposite the first side; coupling first and second metal plates to the first side; coupling one or more antennas to the second side; electrically coupling the first and second metal plates to one or more of the one or more antennas; providing a grounding plate formed of a conductive material; and disposing a layer of insulating material between the metal plate and the grounding plate. In this method, the first metal plate, the grounding plate and the layer of insulating material form a first capacitor and the second metal plate, the grounding plate and the layer of insulating material form a second capacitor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
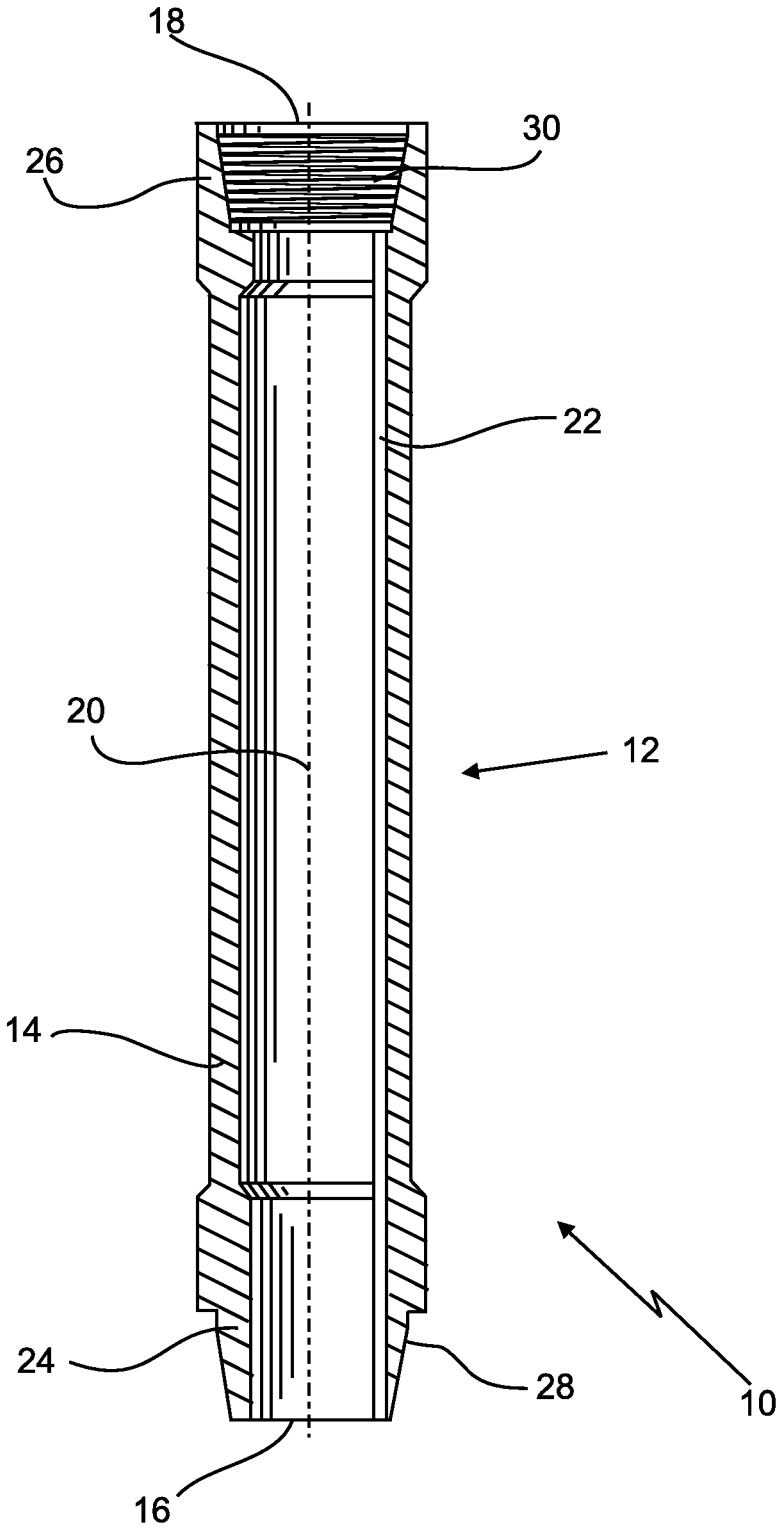
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, and facilitating hydrocarbon production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole and is discharged into the mud tank or other location.

The string 12 includes at least one string or wired pipe segment 14 having an uphole end 16 and a downhole end 18. As described herein, "uphole" refers to a location near the surface relative to a reference location when the segment 14 is disposed in a borehole, and "downhole" refers to a location away from the surface relative to the reference location.

An inner bore or other conduit 20 extends along the length of each segment 14 to allow drilling mud or other fluids to flow therethrough. A transmission line 22 is located within the segment 14 to provide protection for electrical, optical or other conductors to be disposed along the segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric. In one embodiment, the shield layer is electrically coupled to an outer conductor that may be formed, for example, by a rigid or semi-rigid tube of a conductive material.

The segment 14 includes an uphole connection 26 and a downhole connection 24. The segment 14 is configured so that the uphole connection 26 is positioned at an uphole location relative to the downhole connection 24. The downhole connection 24 includes a male connection portion 28 having an exterior threaded section, and is referred to herein as a "pin end" 24. The uphole connection 26 includes a female connection portion 30 having an interior threaded section, and is referred to herein as a "box end" 26.

The pin end 24 and the box end 26 are configured so that the pin end 24 can be disposed within the box end 26 to form a fixed connection there between to connect to an adjacent segment 14 or other downhole component. In one embodiment, the exterior of the male connecting portion 28 and the interior of the female connecting portion 30 are tapered along the length of the segment 14 to facilitate connecting. Although the pin end 24 and the box end 26 are described as having threaded portions, the pin 24 and box 26 ends may be configured to be coupled using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and couplers. The downhole or surface processing unit may also collect and process data generated by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, the string 12 is configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 2:
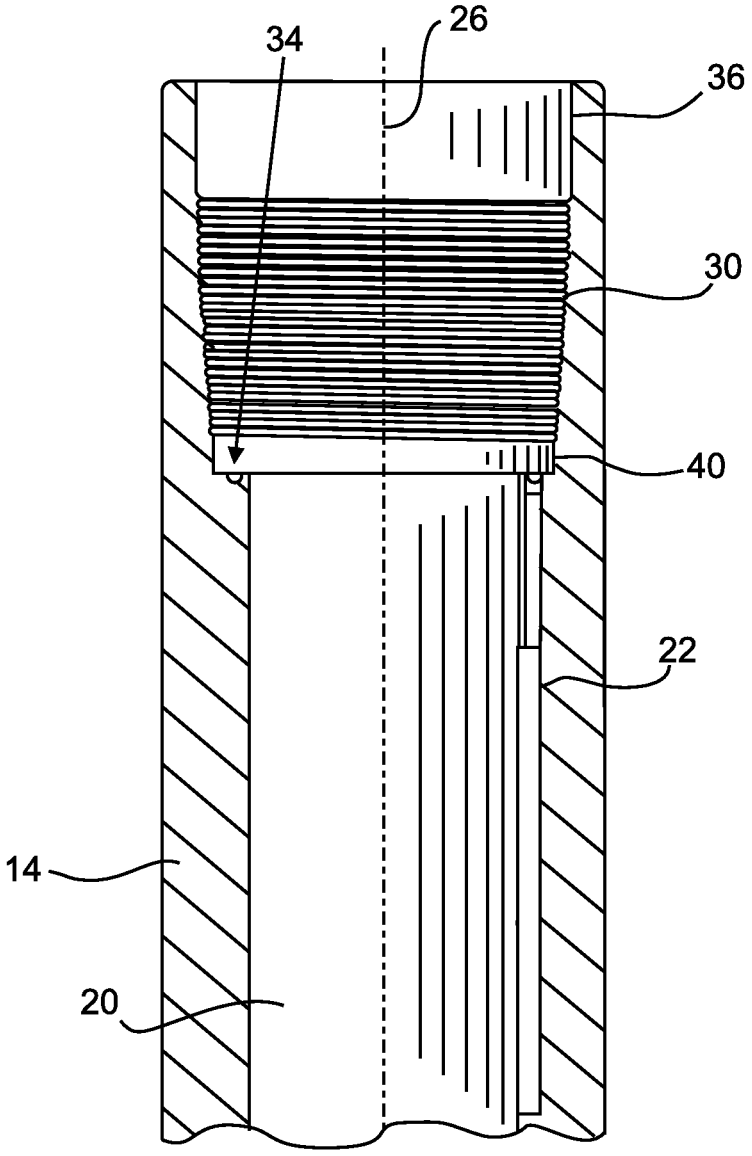
FIG. 2 depicts an exemplary embodiment of a box connector of the segment of FIG. 1.
Figure 3:
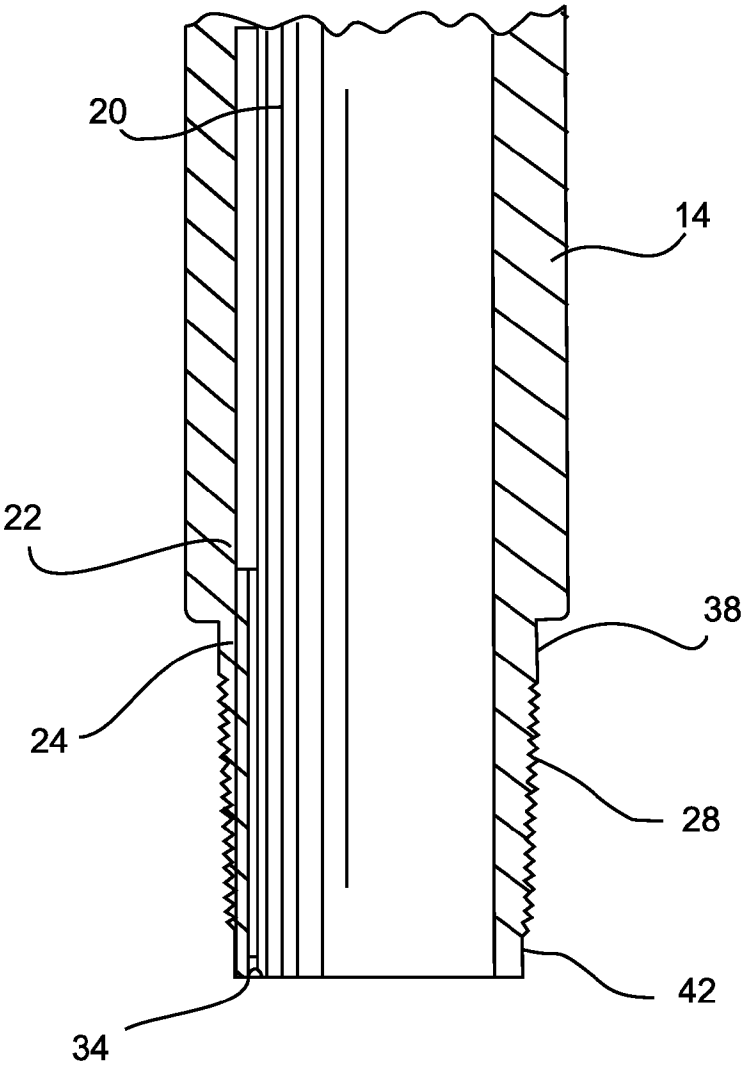
FIG. 3 depicts an exemplary embodiment of a pin connector of the segment of FIG. 1.

Referring to FIGS. 2 and 3, the segment 14 includes at least one coupler 34 disposed therein and located at the pin end 24 and/or the box end 26. The coupler 34 is configured to provide communication of at least one of data and power between adjacent segments 14 when the pin end 24 and the box end 26 are engaged. The coupler 34 may be of any suitable type, such as an inductive coil, capacitive connecting, direct electrical contacts and an optical connection ring. Further, the coupler 34 may be a resonant coupler.

It shall be understood that the coupler 34 could also be included in a repeater element disposed between adjacent segments 14 (e.g., within the box end). In such a case, the data/power is transmitted from the coupler 34 in one segment 14, into the repeater. The signal may then be passed "as is," amplified, and/or modified in the repeater and provided to the adjacent segment 14. Regardless of the configuration, it shall be understood that each coupler 34 can be connected to one or more transmission lines 22.

Figure 4:
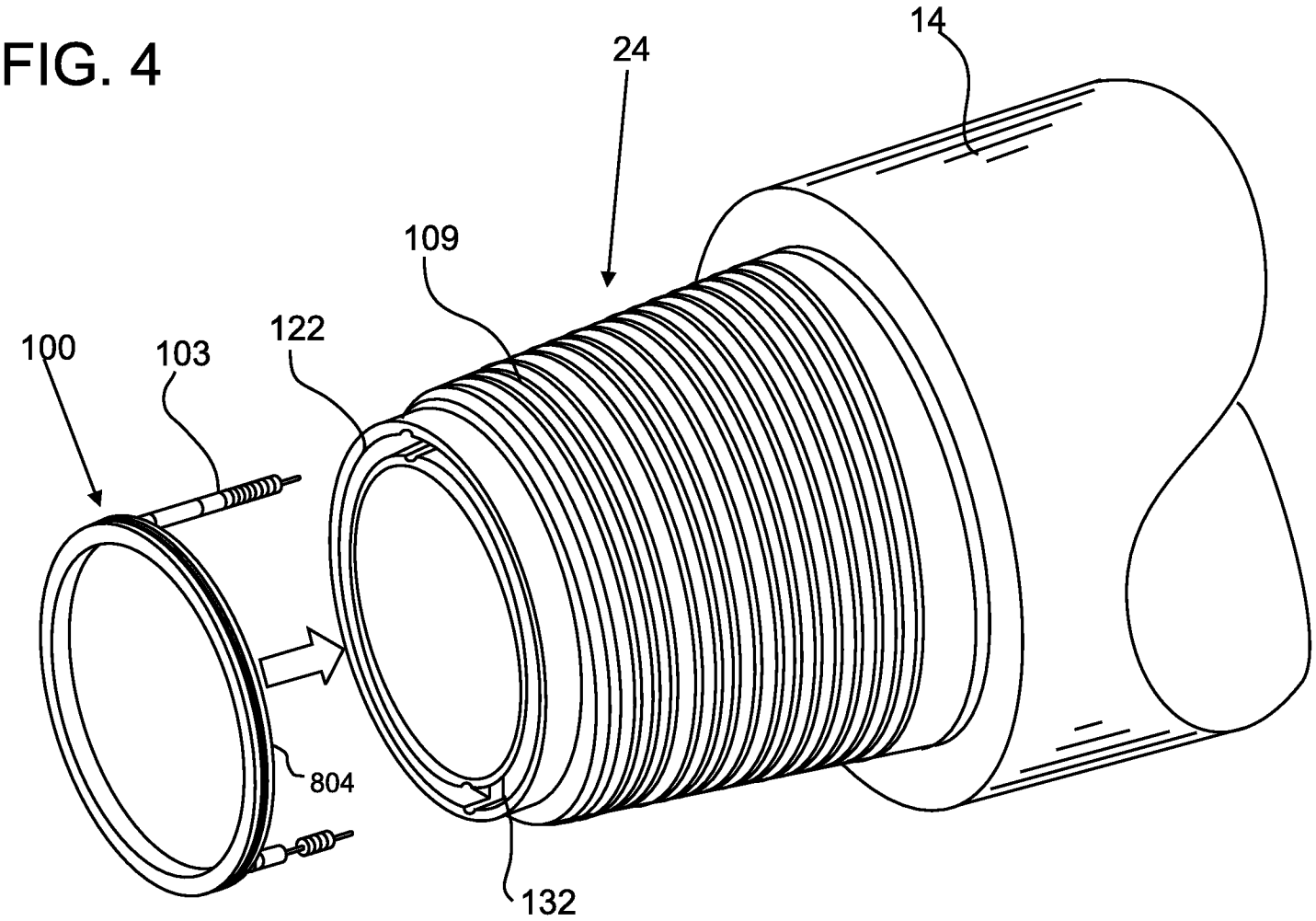
FIG. 4 depicts a pin-end of a wired pipe segment and a wired pipe coupler that is inserted into the pin-end.

FIG. 4 shows an exploded view of a pin end 24 of a segment 14 as adapted to receive an example embodiment of a coupler 100. Embodiments herein are directed to a coupler 100 that is robust enough to withstand downhole conditions (static/dynamic/shock loads, environment) and rough handling on surface when drilling components are being made up, racked back or transported. To this end, and as described below, the couplers 100 disclosed herein below provide integration of several electronic components (e.g., capacitors and inductors) in very limited design space and that can be disposed in a groove formed in the pin 24 or box 26 end of the pipe segment 14. The coupler 100 may provide protection and sealing of the electronic components against high drilling mud pressure.

The pin end 24 includes threads 109 that can be used, as described above, to couple the pin 24 to a box of another segment 14. A distal end 130 of the pin end 24 includes a recess 122 formed therein. As shown, the recess 122 is formed as a groove. Of course the exact configuration of the recess 122 is not limited to only such a configuration. The coupler 100 includes coupler connectors 103 configured to electrically connect to one or more transmission lines (e.g., transmission lines) disposed in the segment 14. The recess 122 is shaped such that it receives the coupler 100 and can include holes 132 to receive the coupler connectors 103 such that the coupler 100 is at least partially, or completely, disposed within the recess 122. It shall be understood that a similar recess can also be formed in the similar manner in the box end (not shown) of the segment 14.

Figure 5:
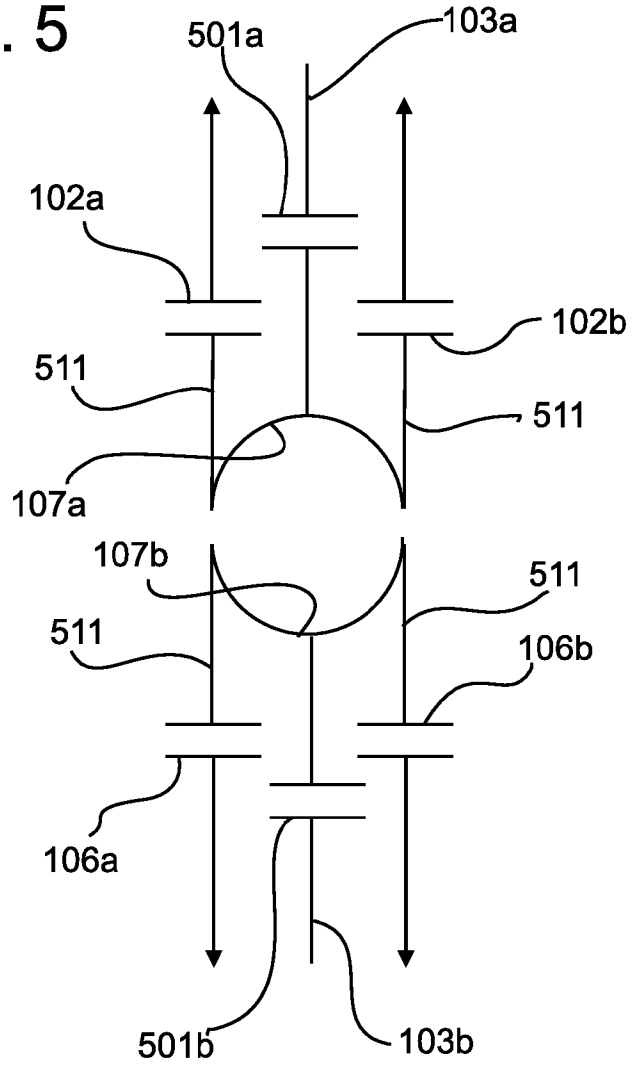
FIG. 5 is a circuit diagram of an embodiment of a wired pipe coupler.

FIG. 5 shows an example circuit that describes one embodiment of a coupler 100 according the present invention. The circuit includes one or more antennas 107*a* and 107*b*. Of course, the particular number of antennas 107 is not limited to only two and more could be included. In general, each antenna 107 transmits a signal that is received on a coupler connector 103 to which it is physically and electrically connected. The signal is then received by a coupler 100 in an adjoining segment.

In the illustrated embodiment, the first antenna 107*a* is physically and electrically (e.g., galvanically) connected to a first coupler connector 103*a* and a second antenna 107*b* is physically and electrically connected to a second coupler connector 103*b*. Of course, only a single antenna could be included in some embodiments.

As will be described in greater detail below, the first and second antennas 107*a*, 107*b* are electrically coupled to one another through an electric component (shown as capacitors 102 and 106) and a ground plane. The ground plane is grounded to a local electrical ground that is formed, for example, by the segment 14. In one embodiment, the first and second antennas 107*a*, 107*b* are semi-circular in shape and extend slightly less than 180 degrees. The first and second antennas 107*a*, 107*b* are connected at both their respective ends to the other antenna through the electronic components 102, 106 and the segment 14 in one embodiment. That is, in one embodiment, each end of each antenna 107 is coupled to separate electronics. Of course, it shall be understood that the exact location on the antenna 107 that is connected to an electronic component 102 could be varied depending on the context.

As illustrated in FIG. 5, the coupler connectors 103 are shown as being electrically connected to the antennas 107 through capacitors 501. It shall be understood that the connectors 103 and antennas 107 could be directly connected without the capacitors 501 or additional electronic elements (e.g., inductors) could also be connected to the antennas 107 to tune them.

It has been discovered that placing a capacitor or other electronic element in a downhole environment may result in damage to capacitor. Further, in making a coupler, the capacitor can be damaged in, for example, a step of sealing the coupler in a protective casing. Teachings herein provide for the creation of one or more capacitor in a coupler that can serve the purposes shown in FIG. 5 and survive the conditions to which it may be exposed either while in use in a downhole environment or during the preparation of the coupler.

According to one embodiment, the capacitors 102, 106 are integrated into the coupler 100 by forming them as plate capacitors where a thin dielectric layer is disposed between capacitor plates. In this embodiment, the plates are formed by a ground plate on one side and a metal or other conductive plate carried by a coupler carrier. In one embodiment, the coupler carrier is shaped in the same or similar shape as the ground plate. In one embodiment, the dielectric is formed of a ceramic foil with a thickness of 0.1 mm. The ceramic foil may be formed, for example, of zirconium dioxide with a dielectric constant of about 30 the plate capacitor easily fits into the design space.

The following description related to FIGS. 6-10 will illustrate how a coupler 100 according to one embodiment may be formed. It shall be understood, however, that the particular order of the formation of the coupler 100 can be varied.

Figure 6:
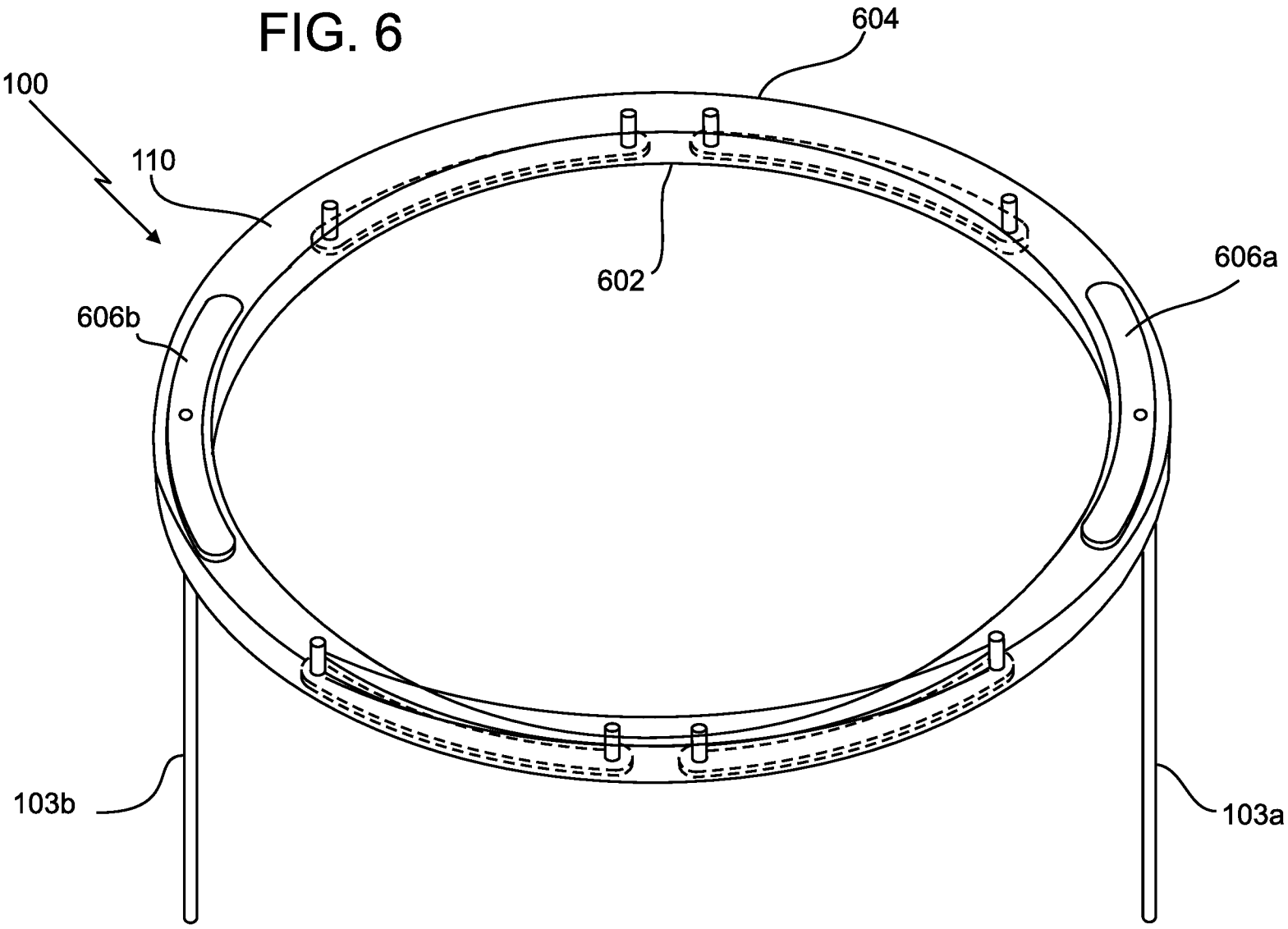
FIG. 6 depicts a coupler carrier attached to coupler connectors according to one embodiment.

As illustrated in FIG. 6, one embodiment of a portion of a coupler 100 includes a coupler carrier 110. The coupler carrier 110 includes first and second sides 602 and 604 that are opposite one another. In one embodiment, the portions of the capacitors 501 (e.g., one of the two plates) mentioned above are disposed within the coupler carrier 110 as is more fully described below. The coupler carrier 110 can be formed at least partially of insulating materials such as, for example, ceramic or plastics like Teflon or polyether ether ketone (PEEK). The exact shape of the coupler carrier 110 can be varied but is shown as circular in the following description.

As illustrated, the coupler carrier 110 is connected to two coupler connectors 103*a* and 103*b*. These connectors 103 (or electrical extensions thereof) pass through the coupler carrier 110 and are in electrical contact with antenna plates 606*a* and 606*b*, respectively that are supported by the second side 604. These antenna plates 606 will form one side of the capacitors 501 shown in FIG. 5. It shall be understood that it may be possible to electrically couple the connectors 103 to the antenna plates 606 without having the connectors 103 pass through the coupler carrier 110. The antenna plates 606 can be formed of metal or any other material suitable for the formation of a capacitor plate. In one embodiment, the antenna plates 606 sit on top of the coupler carrier 110. In another embodiment, the antenna plates 606 are disposed in recesses formed in the second side 604 of the coupler carrier 110.

Figure 7:
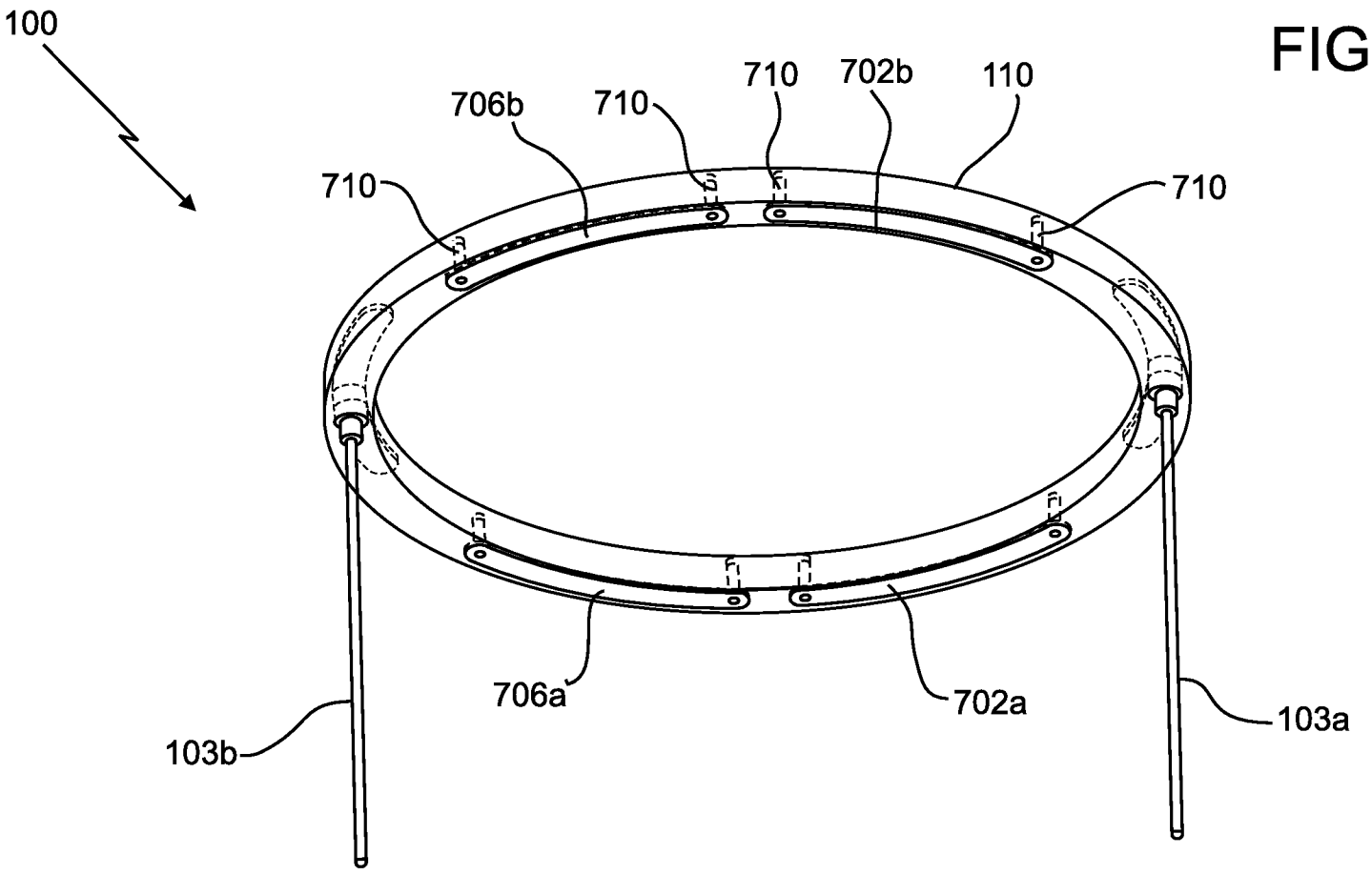
FIG. 7 depicts the coupler carrier of FIG. 6 after plates have been attached thereto.

FIG. 7 illustrates a portion of the coupler 100 after plates 702*a*, 702*b*, 706*a* and 706*b* have been coupled to the first side 602 of the coupler carrier 110. Plates 702*a* and 702*b* will form one of the capacitor plates for capacitors 102*a* and 102*b*, respectively, shown in FIG. 5. Likewise, plates 706*a* and 706*b* will form one of the capacitor plates for capacitors 106*a* and 106*b*, respectively, shown in FIG. 5.

The plates 706 can be formed of metal or any other material suitable for the formation of a capacitor plate. In one embodiment, the plates 702, 706 sit on the surface of the coupler carrier 110. In another embodiment, the plates 702, 706 are disposed in recesses formed in the first side 602 of the coupler carrier 110.

The plates 702, 706 are electrically coupled to through pins 710 that pass through the coupler carrier 110. The pins 710 will provide for the electrical connection between the antennas 107*a* and 107*b* (FIG. 5) and the plates 702, 706. In particular, the through pins 710 can form the electrical connection labeled by reference numeral 511 in FIG. 5.

Figure 8A:
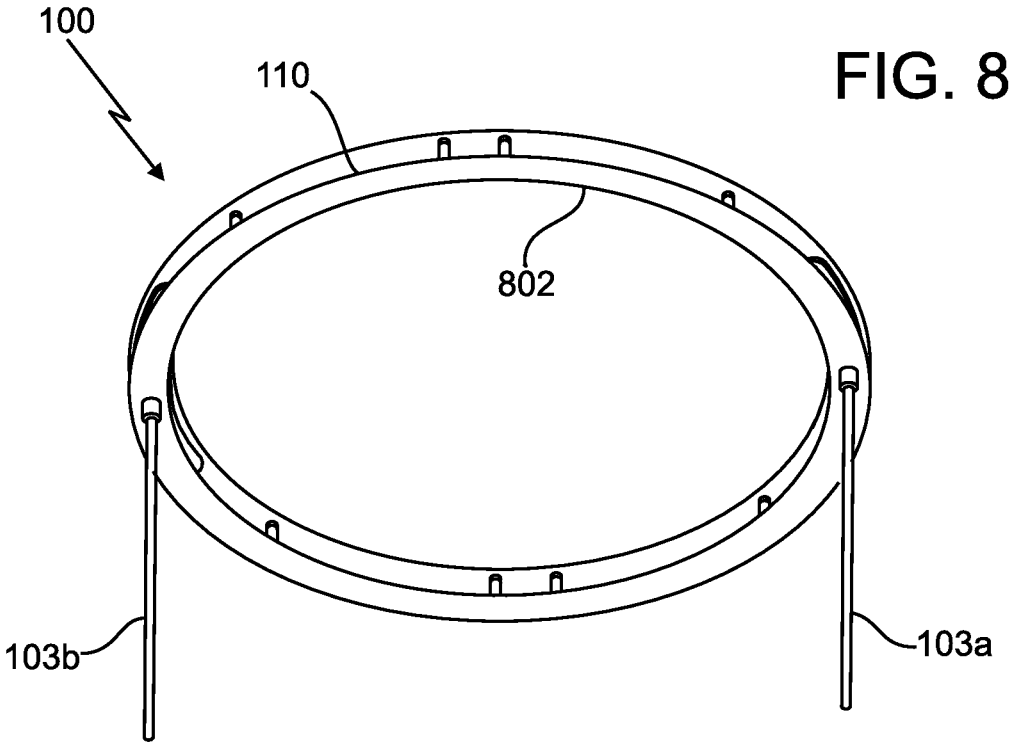
FIGS. 8A-8B depict the coupler carrier of FIG. 7 after an insulating layer and a grounding plate, respectively, have been attached thereto.
Figure 8B:
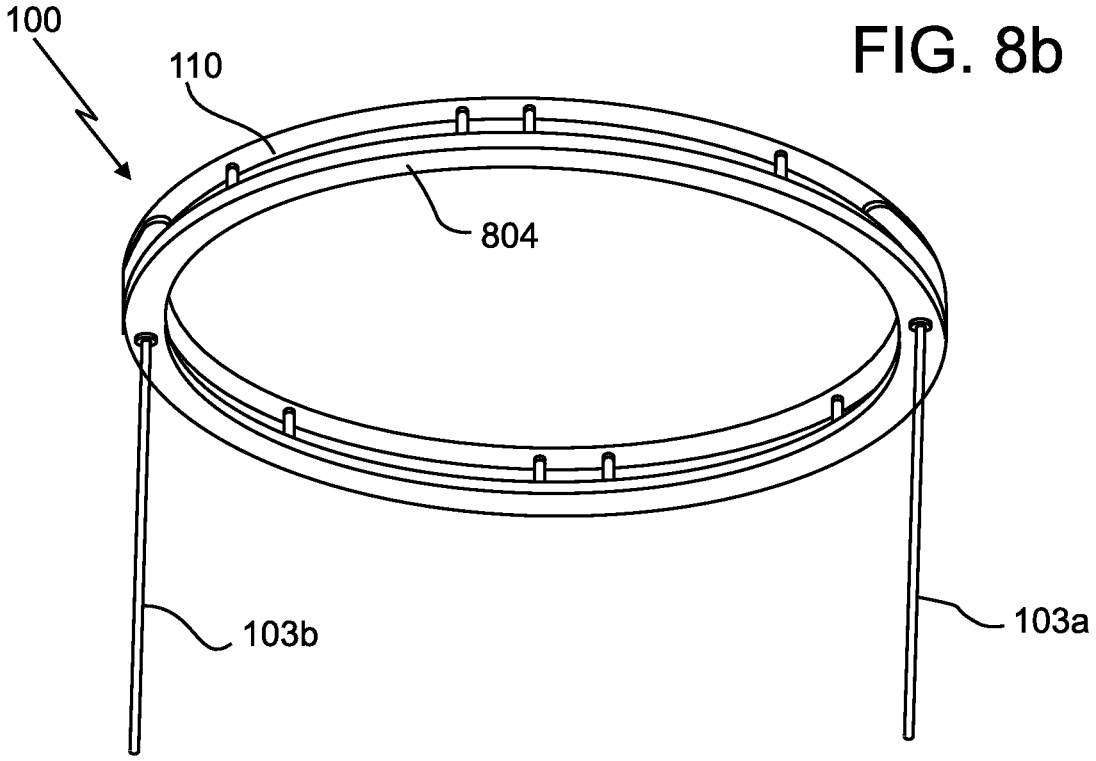

After the plates 702, 706 have been coupled to or are otherwise supported by the first side 602, a layer of dielectric material 802 is disposed on the first side 602 such that it covers the plates 702, 706 as shown in FIG. 8*a*. A grounding plate 804 is then affixed to the first side 602 as shown in FIG. 8*b*. This grounding plate 804 is separated from the plates 702, 706 by the layer dielectric material 802. Thus, the plates 702, 706, in combination with the grounding plate 802 form capacitors 102 and 106 shown in FIG. 5. As shown, the grounding plate 804 is a continuous element. Of course, the grounding plate 804 could be formed by a plurality of individual grounding plates that are electrically coupled and arranged to interact with the plates 702, 706 that form the other side of the capacitors. In one embodiment, the coupler carrier 110 and the grounding plate 804 have the same or a similar shape. Of course, this is not required.

The grounding plate 802 can be formed of metal (e.g., conductive steel) or any other material suitable for the formation of a capacitor plate. The layer of dielectric material 802, in one embodiment, is formed of a ceramic foil with a thickness of 0.1 mm. The ceramic foil may be formed, for example, of zirconium dioxide with a dielectric constant of about 30.

With reference again to FIG. 4, as the coupler 100 is inserted into the recess 122, the grounding plate 804 will make electric (capacitive or direct DC) contact with the segment 14. In manner, the coupler 100 can be grounded to the segment 14. In such a case, the grounds shown in FIG. 5 are electrically at the same potential as the segments 14.

Figure 9:
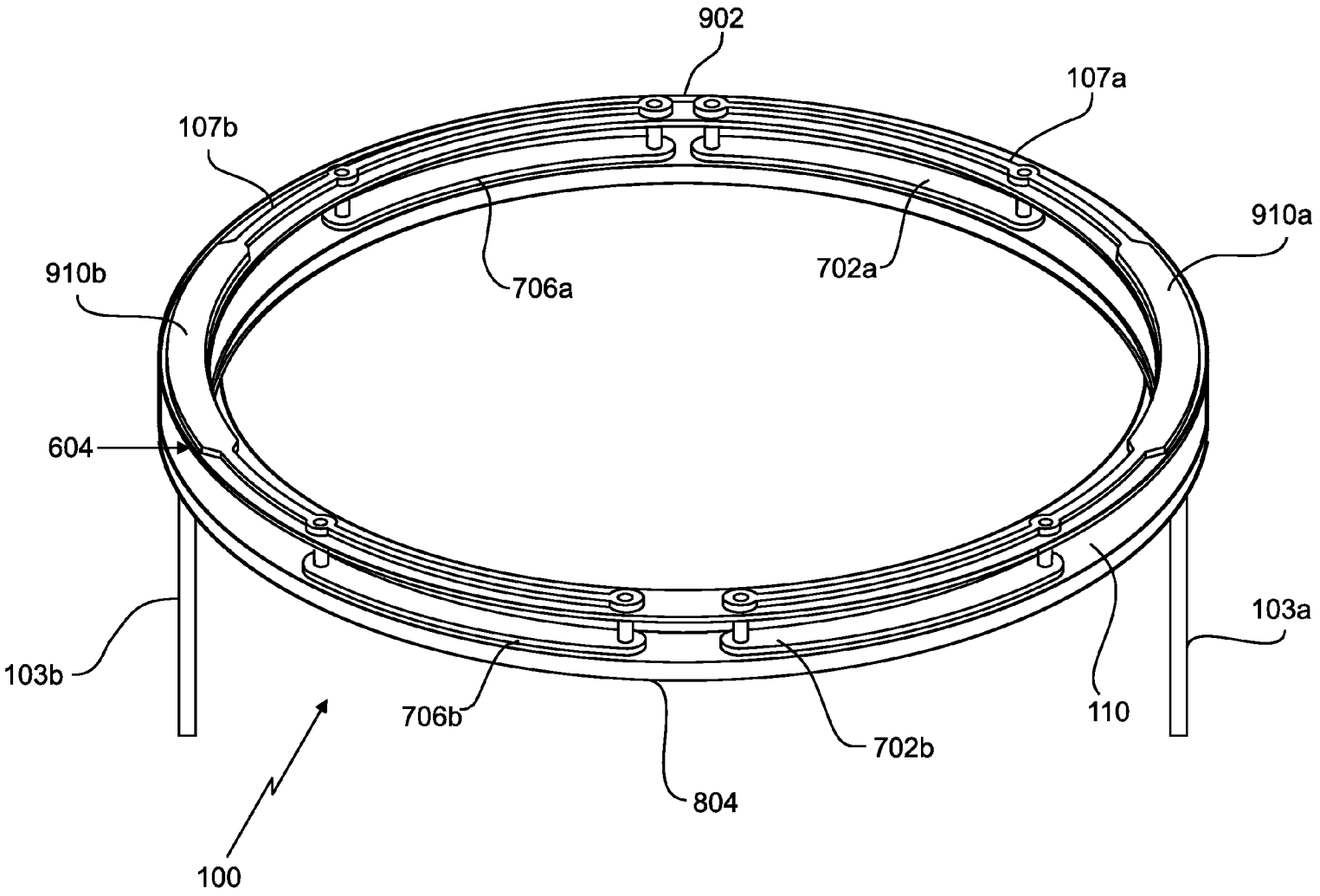
FIG. 9 depicts the coupler carrier of FIG. 8 after antennas have been coupled thereto.

With reference now to FIG. 9, a coupler 100 that includes antennas 107*a*, 107*b* carried by the second side 604 is illustrated. Similar to the first side 602 as described above, the second side 604 includes an antenna layer 902 disposed thereon. The antenna layer 902 covers the antenna plates 606*a*, 606*b* (FIG. 6). The antenna layer 902, in one embodiment, is formed of a ceramic foil with a thickness of 0.1 mm. The ceramic foil may be formed, for example, of zirconium dioxide with a dielectric constant of about 30.

Antennas 107*a* and 107*b* include a portion that overlays the antenna plates 606*a*, 606*b*. In FIG. 9 these are shown as regions of increased width 910*a* and 910*b*. It shall be understood that sizing of these regions is shown as increased to illustrate that they form the second side capacitors 501*a* and 501*b* with the first side being antenna plates 606*a*, 606*b* but such sizing is not required.

The antennas 107*a*, 107*b* are electrically coupled to plates 702, 706 via the through pins 710 as discussed above. As the plates 702, 706 form capacitors with the ground plane 804, each antenna 107 is connected to ground through capacitors 501 at each end as shown in FIG. 5.

Figure 10:
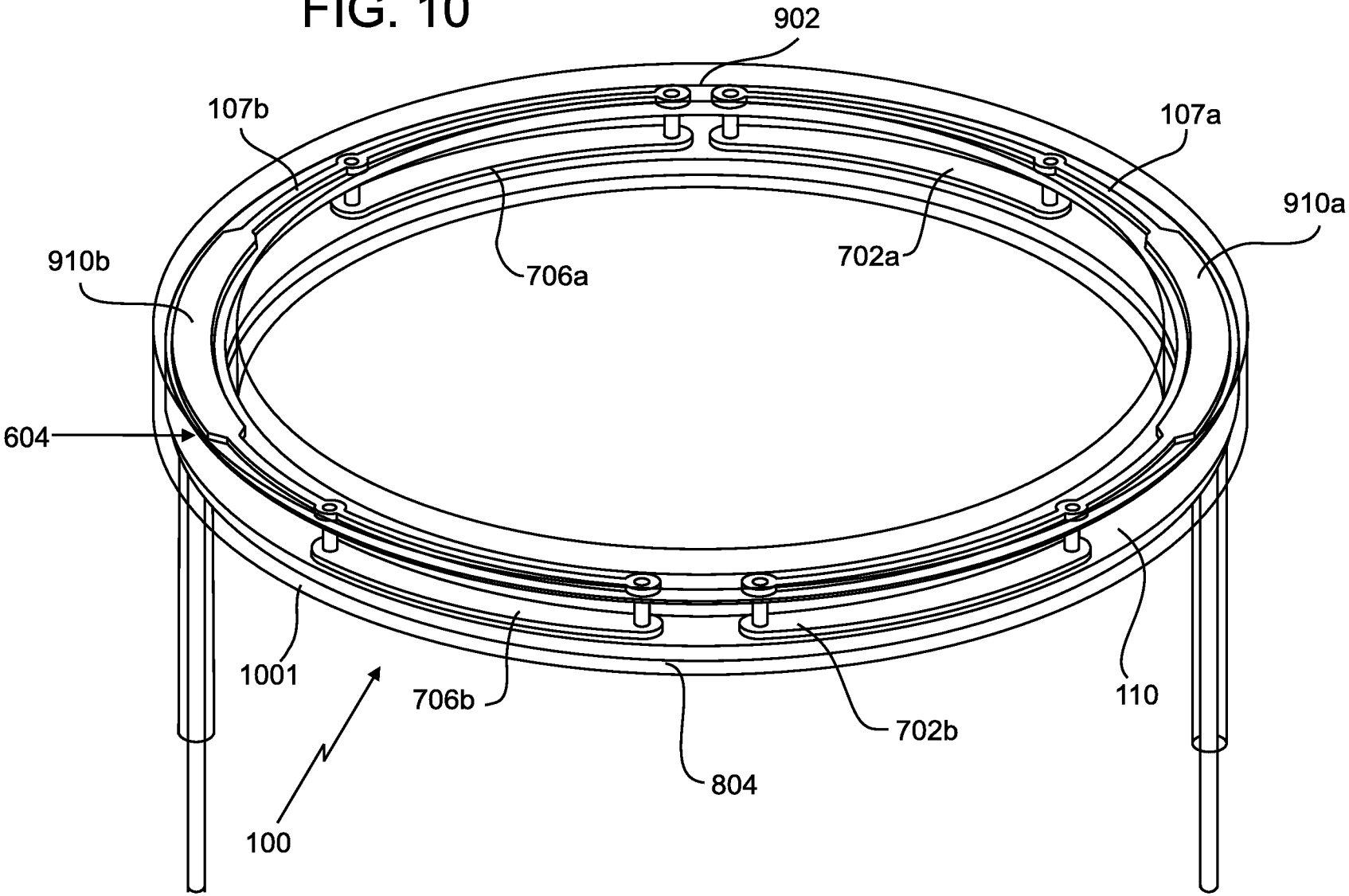
FIG. 10 shows an embodiment of a completed wired pipe coupler.

FIG. 10 shows the coupler 100 of FIG. 9 with a phantom illustration of a sealing layer 1001 that surrounds at least the coupler carrier 110, the antennas 107 and at least partly the ground plane 804. As will be understood, in this manner, the capacitors formed between these elements as described are sealed and protected. In one embodiment, at least some of the coupler connectors 103 are also contained within the sealing layer 1001. In one embodiment, the sealing layer 1001 is formed of PEEK. In one embodiment the side 602 (of the final assembly) as well as the inner diameter and outer diameter surface area is plated with a conductive material such as copper plating. In the case where the ground plate is not fully encapsulated by the sealing layer 1001 the copper plating allows for large surface area galvanic coupling between coupler and groove 122 when the coupler is installed. In another embodiment the ground plate is fully enclosed by the sealing area 1001. The inner and outer diameter surface as well as the side 602 are plated by an electrically conductive material. The surface of the ground plate together with the dielectric material of the (thin) sealing layer 1001 form another (grounding) capacitor serving as the ground connection for the entire coupler structure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wired pipe coupler comprising:
- a coupler carrier having a first side and a second side opposite the first side;
- first and second metal plates carried by the first side;
- one or more antennas supported by the second side;
- one or more electrical connectors electrically coupling the metal plates to one or more of the one or more antennas;
- a grounding plate formed of a conductive material; and
- a layer of insulating material disposed between the metal plates and the grounding plate;
- wherein the first metal plate, the grounding plate and the layer of insulating material form a first capacitor and the second metal plate, the grounding plate and the layer of insulating material form a second capacitor.

2. The wired pipe coupler of claim 1, further comprising:
- an insulating layer disposed between the coupler carrier and the one or more antennas.

3. The wired pipe coupler of claim 2, wherein the insulating layer is formed of a ceramic foil.

4. The wired pipe coupler of claim 1, further comprising:
- a mold material that surrounds the coupler carrier, the grounding plate and the one or more antennas.

5. The wired pipe coupler of claim 4, wherein the mold material is formed of polyether ether ketone (PEEK).

6. The wired pipe coupler of claim 1, wherein the electrical connectors pass through the coupler carrier.

7. The wired pipe coupler of claim 1, wherein the coupler carrier is formed of polyether ether ketone (PEEK).

8. The wired pipe coupler of claim 1, wherein the first metal plate is disposed in a recess formed in the first side.

9. The wired pipe coupler of claim 1, wherein the coupler carrier and the grounding plate have a circular cross-section of substantially the same size.

10. The wired pipe coupler of claim 1, in combination with:
- a pipe segment having a body extending from a box end to a pin end;
- wherein the wired pipe coupler is located in one of the box end and the pin end.

11. The wired pipe coupler of claim 10, wherein the pipe segment includes a transmission line extending away from the coupler towards the other of the box and pin end and in electrical communication with the one or more antennas.

12. The wired pipe coupler of claim 1, further comprising:
- an antenna plate supported by the second side; and
- an antenna dielectric layer disposed between the antenna plate and the one or more antennas.

13. A method of forming a wired pipe coupler, the method comprising:
- providing a coupler carrier having a first side and a second side opposite the first side;
- coupling first and second metal plates to the first side;
- coupling one or more antennas to the second side;
- electrically coupling the first and second metal plates to one or more of the one or more antennas;
- providing a grounding plate formed of a conductive material; and
- disposing a layer of insulating material between the metal plate and the grounding plate;
- wherein the first metal plate, the grounding plate and the layer of insulating material form a first capacitor and the second metal plate, the grounding plate and the layer of insulating material form a second capacitor.

14. The method of claim 13, further comprising:
- disposing an insulating layer between the carrier and the one or more antennas.

15. The method of claim 13, further comprising:
- encasing the carrier, the grounding plate and the one or more antennas in a mold material.

16. The method of claim 15, wherein the mold material is formed of polyether ether ketone (PEEK).

17. The method of claim 13, wherein coupling the metal plates to the first side includes disposing the first metal plate in a recess formed in the first side.

18. A wired pipe system comprising:
- a wired pipe segment having a first end and a second end; and
- a first coupler in the first end, the first coupler comprising:
  - a coupler carrier having a first side and a second side opposite the first side;
  - first and second metal plates carried by the first side;
  - one or more antennas supported by the second side;
  - one or more electrical connectors electrically coupling the metal plates to one or more of the one or more antennas;
  - a grounding plate formed of a conductive material; and
  - a layer of insulating material disposed between the metal plates and the grounding plate;
  - wherein the first metal plate, the grounding plate and the layer of insulating material form a first capacitor and the second metal plate, the grounding plate and the layer of insulating material form a second capacitor.

19. The wired pipe system of claim 18, further comprising:
- a second coupler in the second end.

20. The wired pipe system of claim 19, further comprising:
- a transmission line electrically connecting the first coupler to the second coupler.

* * * * *